US006981340B2

(12) United States Patent
Evans

(10) Patent No.: US 6,981,340 B2
(45) Date of Patent: Jan. 3, 2006

(54) FOOTWEAR PROTECTOR

(75) Inventor: Adrian L. Evans, Corpus Christi, TX (US)

(73) Assignee: Celeste Y. Lutz, Corpus Christi, TX (US), part interest ( * ) Notice: Subject to any disclaimer, the term of this patent is extended or adjusted under 35 U.S.C. 154(b) by 10 days.

(21) Appl. No.: 10/635,321

(22) Filed: Aug. 6, 2003

(65) Prior Publication Data

US 2005/0066551 A1 Mar. 31, 2005

(51) Int. Cl.
*A43B 3/20* (2006.01)

(52) U.S. Cl. ..... 36/7.2; 36/131; 36/72 R

(58) Field of Classification Search ..... 36/131, 36/7.2, 7.4, 7.7, 72 R
See application file for complete search history.

(56) References Cited

U.S. PATENT DOCUMENTS 900,499 A * 10/1908 Eckhard, Jr. ..... 36/72 R
1,260,888 A * 3/1918 Farley ..... 36/7.2
1,326,542 A * 12/1919 Stebor, Jr. ..... 36/72 R
1,567,714 A * 12/1925 Dessau ..... 36/7.4
1,634,540 A * 7/1927 Harrison ..... 36/7.4
2,292,770 A * 8/1942 Platkin ..... 36/7.2
3,126,651 A 3/1964 Bown
D219,136 S * 11/1970 Mace ..... D2/913
3,812,606 A 5/1974 Merola
4,005,534 A * 2/1977 Crist et al. ..... 36/72 R
D252,296 S * 7/1979 Alegria ..... D2/913
D323,240 S * 1/1992 Cornell ..... D2/913
5,168,644 A 12/1992 Ellis
5,469,644 A * 11/1995 Vidler ..... 36/127
5,855,078 A 1/1999 Starker
5,873,185 A 2/1999 Harris
6,286,234 B1 9/2001 Smith
D470,647 S * 2/2003 Johnson ..... D2/913

* cited by examiner

*Primary Examiner*—Ted Kavanaugh
(74) *Attorney, Agent, or Firm*—G. Turner Moller

(57) ABSTRACT

A device for protecting footwear of a motorcycle rider comprises a sole of a water impermeable material, an upper of bodily flexible material and an adjustable strap for securing the device to footwear of the rider. The device is typically worn on the left foot of the rider because motorcycle transmissions are shifted by the left foot, leaving a characteristic wear pattern on the left shoe or boot of the rider. The upper allows substantial air movement around the rider's footwear and may be partially or wholly insulated with a foam layer in the upper. Some embodiments provide greater air circulation and less insulation. Two types of adjustable straps are shown.

8 Claims, 2 Drawing Sheets

FOOTWEAR PROTECTOR

This invention acts to prevent damage to footwear worn by a motorcycle rider which is caused by shifting the transmission of the motorcycle.

BACKGROUND OF THE INVENTION

To date, motorcycles are equipped with a manually shiftable gear transmission. Typically, shifting of the transmission is done by manipulation of a lever with a foot of the driver. Motorcycle transmission levers are, to date, universally on the left side of the transmission case, so it is manipulated with the left foot. The gear shift lever is positioned so the gear shift lever is engaged by the top of the rider's foot, at a location adjacent or rearward of the knuckle of the big toe. The left shoe or boot of a motorcycle rider is accordingly worn in a characteristic pattern by manipulating the gear shift lever.

A simple footwear protective device that is widely used by practical motorcycle riders is simply a large athletic sock that is big enough to pass over the rider's footwear. Often, the rider cuts the sock to leave a band of fabric of 3" or so wide, or of sufficient width to extend from about the knuckle of the big toe to or intermediate any shoe lacings. There are many problems with socks as shoe protectors. They don't stay on the foot well at all because the only thing holding them on is the elasticity of the sock fabric and because they tend to roll up. Socks used in this manner quickly become unsightly because they get so dirty they cannot be washed and they unravel.

In response to this problem, a number of footwear protective devices have been proposed in the prior art, as shown in U.S. Pat. Nos. 5,168,644; 5,855,078; 5,873,185 and 6,286,234. A similar structure is found in U.S. Pat. No. 3,126,651.

SUMMARY OF THE INVENTION

The motorcycle riding universe, like most others, is not a monolithic group in which all are alike. There is a segment of rough and tumble types, a segment of older middle class riders, a segment of riders of what are known as sport bikes, and others. In one sense, this invention is aimed at sport bike riders. Sport bike riders are characterized by being well dressed and being interested in the appearance of both the motorcycle and the rider and are accordingly a natural group of buyers of footwear protective devices to prevent damage to the rider's left boot or shoe.

In this invention, a footwear protective device comprises a sole of water impermeable material, an upper of bodily flexible material and a strap for holding the device on the user's footwear. The sole is preferably of rubber like material and is relatively stiff compared to the upper. The sole accordingly makes the device quite durable. The sole extends rearwardly on the rider's footwear to a location short of the heel of the rider's shoe or boot. The sole is preferably rather thin so the rider can walk with the footwear protector in place without noticing it is being worn.

The upper is preferably a fabric which tends to shed water and provides for air circulation around and/or through the protective device. In a preferred embodiment, an open toe allows air passage through the protective device cooling the rider's foot and allowing the upper to dry if it has become wet. The open toe also provides considerable flexibility so the upper conforms to shoe or boots of different design. The preferred embodiment also preferably provides a layer of insulation, at least on the side facing the transmission which acts to keep the rider's foot cool during long rides. Other embodiments provide greater air circulation and less insulation. The strap is designed to hold the protective device comfortably on the rider's footwear with a minimum of bother.

It is an object of this invention to provide an improved protector that is used to prevent damage to footwear of a motorcycle rider.

A further object of this invention is to provide a footwear protector for motorcycle riders which is inexpensive, durable, washable and acts to prevent damage to the rider's gear shifting shoe or boot.

Another object of this invention is to provide a footwear protective device that may be made of different colors and/or different textures to provide an attractive accessory for a motorcycle rider.

These and other objects and advantages of this invention will become more apparent as this description proceeds, reference being made to the accompanying drawings and appended claims.

DETAILED DESCRIPTION

Figure 2:
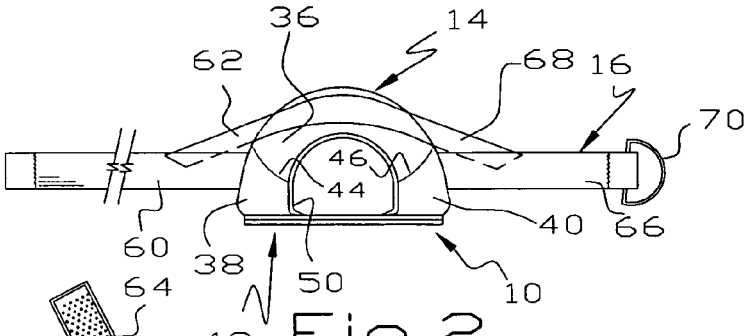
FIG. 2 is a front view of the footwear protective device of FIG. 1, showing an adjustable strap splayed outwardly so it can be seen.
Figure 1:
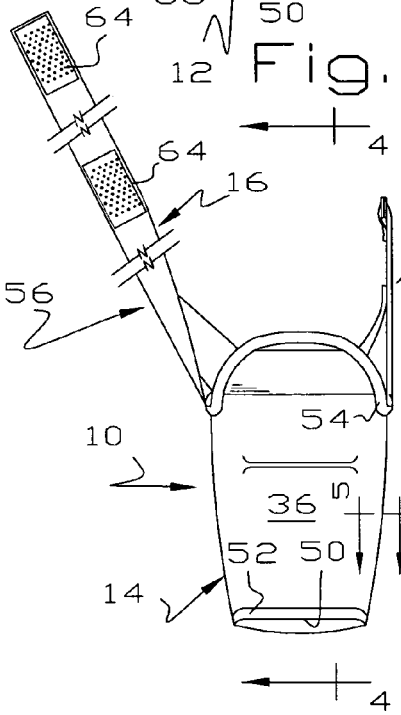
FIG. 1 is a top view of a footwear protective device of this invention.

Referring to FIGS. 1–5, a footwear protective device 10 of this invention is illustrated. The device 10 comprises, as major components, a sole 12, an upper 14 and an adjustable strap 16 for securing the device 10 to a motorcycle rider's boot or shoe 18. The motorcycle rider's boot or shoe 18 is of conventional type including a sole 20, a heel 22, and an upper 24. As will be more fully apparent hereinafter, an important feature of this invention is the sole 12 of the device 10 terminates substantially forward of the heel 22 of the rider's footwear 18.

The sole 12 is made of a durable, water impermeable material typical of shoe soles in general, such as leather, soft plastic, rubber or the like and is preferably a pair of thin flat rubber or rubber like sheets or sections 26, 28. As shown best in FIG. 5, the upper 14 is sewn to the uppermost sole section 26 by a row of stitches 30 and the sewn assembly is glued or otherwise attached to the lowermost sole section 28. As will become more fully apparent hereinafter, the sole 12 is considerably more rigid than the upper 14 and is of the same order of stiffness as normal shoe soles.

Figure 5:
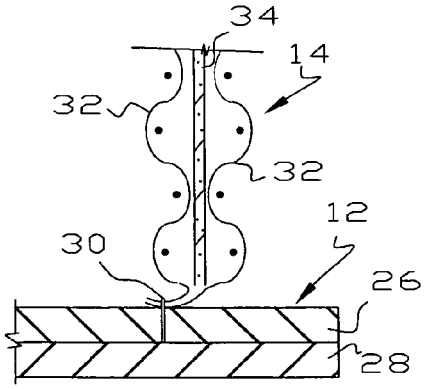
FIG. 5 is an enlarged cross-sectional view of the footwear protector of this invention, taken substantially along line 5—5 of FIG. 1, as viewed in the direction indicated by the arrows.

The upper 14 is made of a bodily flexible material, preferably a pair of fabric layers 32 and an interior foam insulating layer 34 as shown in FIG. 5. The fabric layers 32 are preferably smooth and inelastic so the device 10 more easily slips onto the footwear of the rider. The foam layer 34 provides thermal insulation thereby minimizing heat transfer from the transmission to the rider's foot. As shown in FIGS. 1–4, the upper 14 is made of a central panel 36 and two lateral panels 38, 40 sewn together along seams 44, 46. It will accordingly be seen that the upper 14 provides a rearwardly open receptacle receiving the forward end of the rider's footwear as shown in dashed lines in FIG. 3. Preferably, the upper provides an open toe 50 allowing air to flow through the receptacle, around the rider's footwear thereby cooling the rider's foot and promoting rider comfort. Suitable sewn seams 52, 54 terminate the edges of the upper 14 in a conventional manner.

The adjustable strap 16 may be of any suitable type or configuration to secure the protective device 10 to the rider. A preferred arrangement is shown in FIGS. 1–4 where the strap 16 includes a first section 56 attached to one side of the upper 14 and a second section 58 attached to the other side of the upper 14. The first strap section 56 includes a long piece 60 sewn to the upper 14 and extending generally parallel to the sole 12. A short diagonal piece 62 sewn to the long piece 60 and to the upper 14 at a location above the terminus of the long piece 60. A pair of hood-and-loop connectors 64 are provided to tie down the end of the long piece 60 as will become more fully apparent hereinafter. The strap 16 is adjustable in any suitable manner, as by making the connectors 64 of considerable length, as will become more fully apparent hereinafter.

The second strap section 58 includes a first piece 66 sewn to the upper 14 and generally parallel to the sole 12. A second shorter diagonal piece 68 is sewn between the upper 14 and the first piece 66. A pair of D-rings 70 are sewn into the end of the first piece 66 so the end of the strap section 56 can be looped through the D-rings 70. By passing the end of strap section 56 through the D-rings 70 so the connectors 64 abut, a loop is formed by the strap 16 around the back or heel of the upper 24 of the footwear 18 shown in FIG. 3. The size of the loop is adjustable because the connectors 64 are of considerable length and thus can be overlapped to one degree or other. It will be seen that the loop lies along a line 72 on the back of the footwear 18 and the sole 12 terminates well forward of the heel 22. Thus, the sole 12 terminates about midway between the toe end of the device 10 and the heel 22, by which it is meant that the sole 12 extends between about 30–70% of the distance between the toe end of the device 10 and the line 72. As seen best in FIGS. 1–4, the pieces 62, 68 may comprise opposite ends of a length of strap passing under and sewn to the seam 54.

Figure 3:
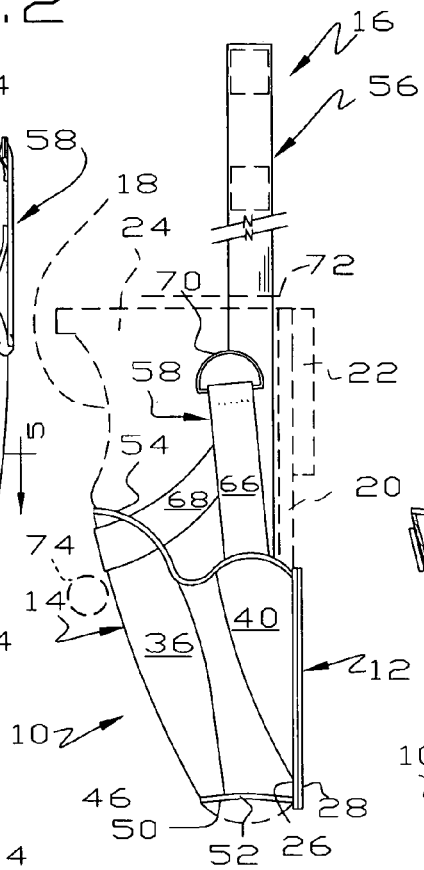
FIG. 3 is a side view of the footwear protective device of FIGS. 1 and 2.
Figure 4:
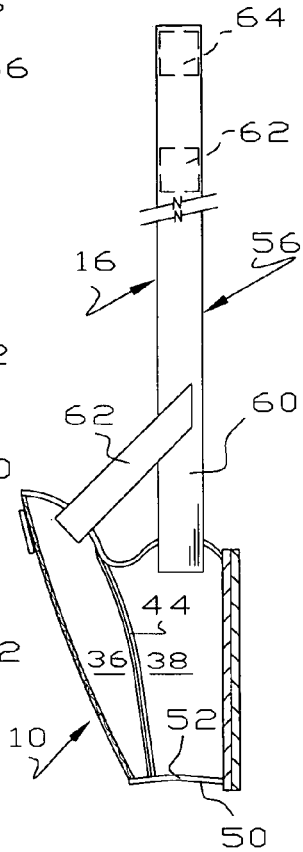
FIG. 4 is a cross-sectional view of the footwear protective device of FIG. 1, taken along line 4—4, as viewed in the direction indicated by the arrows.

Use of the footwear protective device 10 should now be apparent. The rider puts his left foot into the receptacle provided by the upper 14 so the toe of the shoe or boot 18 extends to or through the open toe 50. The strap 16 is threaded through the D-rings 70 to provide a loop extending around the heel of the rider's shoe 18 and then cinched up. The upper 14 covers the area from the rider's big toe and to where the rider's leg begins. Thus, as shown in FIG. 3, there is plenty of room and plenty of material to abut and manipulate the gear shift lever 74. It will be seen that the upper 14 is perforate to allow easy air flow through the receptacle and around the rider's footwear 18.

Figure 6:
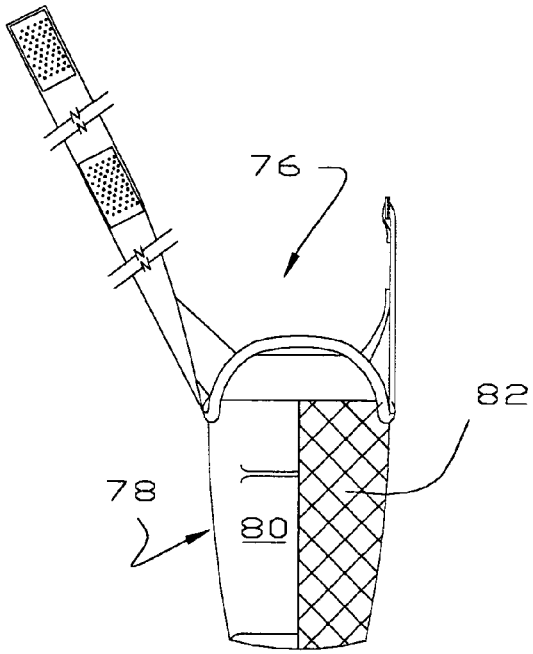
FIG. 6 is a top plan view of another embodiment of this invention.

Referring to FIG. 6, there is illustrated another embodiment of a footwear protective device 76 of this invention. The device 76 is substantially identical to the device 10 except the upper 78 is made of a combination fabric/foam insulating material 80 on the left and a large mesh fabric 82 on the right. The material 80 provides protection to the rider's footwear and the mesh fabric 82 supports the edge of the material 80 and provides for air circulation around the rider's footwear.

Figure 7:
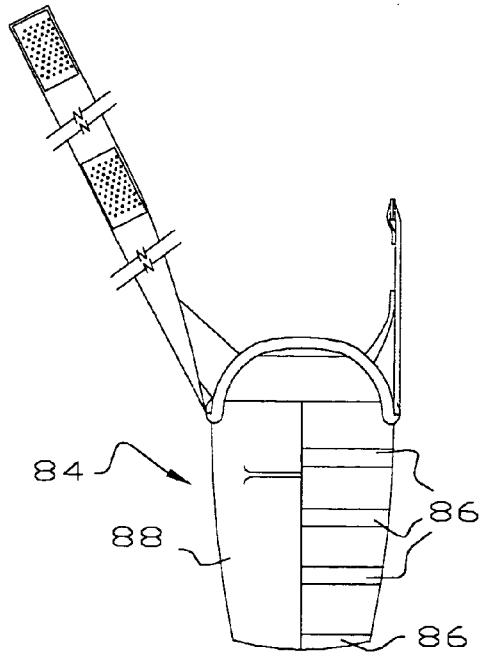
FIG. 7 is a top plan view of another embodiment of this invention.

Referring to FIG. 7, there is illustrated another embodiment of a footwear protective device 84 of this invention. The device 84 is substantially identical to the device 76 except the mesh fabric 82 has been replaced by a series of straps 86 sewn to the sole. The combination fabric/foam insulating material 88 provides protection to the rider's footwear and the straps 86 support the edge of the material 88 and provide for air circulation around the rider's footwear.

Figure 8:
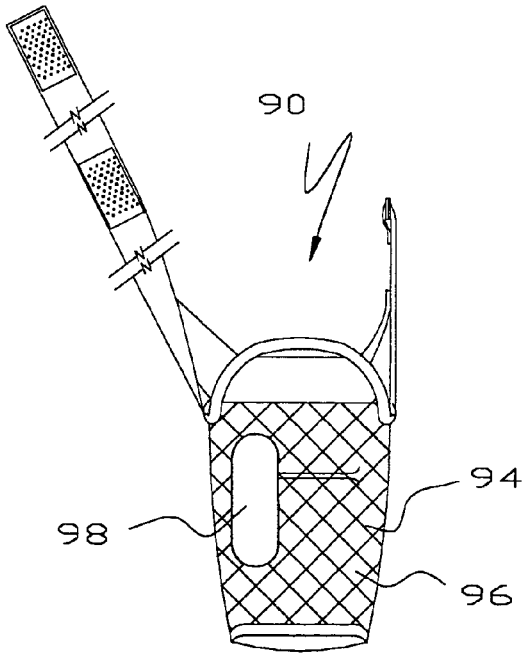
FIG. 8 is a top plan view of another embodiment of this invention.

Referring to FIG. 8, there is illustrated another embodiment of a footwear protective device 90 of this invention. The device 84 is substantially identical to the device 76 except the upper 92 comprises a large mesh fabric 94 spanning the sides of the sole 96 and a leather or heavy vinyl pad 98 bonded to the mesh fabric 94. The pad 98 provides protection to the rider's footwear and the mesh fabric 94 supports the pad 98 and provides air circulation around the rider's footwear. The device 90 conveniently provides an open toe assisting the mesh fabric 94 to conform to the shape of the rider's footwear.

Figure 9:
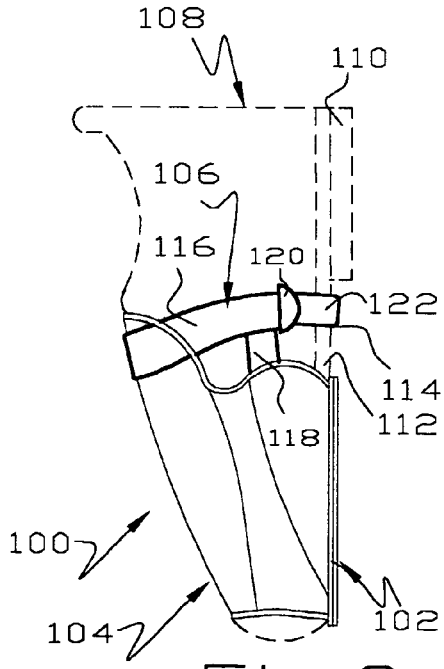
FIG. 9 is a side elevational view of another embodiment of this invention.

Referring to FIG. 9, there is illustrated another embodiment of a footwear protective device 100 of this invention having a sole 102, an upper 104 and an adjustable strap 106. The device 100 may be substantially identical to any of the devices 10, 76, 84, 90 except the strap 106 is designed to pass under the rider's footwear 108 rather than past the rider's heel. Most shoes and boots with heels 110 have soles 112 that are slightly concave thereby providing a recessed location 114 for the strap 106. The strap 106 provides a pair of legs 116, 118 connected to spaced locations on the upper 104. One of the legs 116 includes one or more D-rings 120 for receiving an end of a strap section 122 connected in a similar manner to the opposite side of the device 100.

It will be seen that the soles of the various footwear protective devices 10, 76, 84, 90, 100 are generally flat in the sense that the soles lack a heel of a thickness greater than the heels 22, 110 of the shoe or boot with which the protective devices are used. Partially for this reason, a rider can walk wearing the protective devices and not be aware of wearing them.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A footwear protective device for protecting the top of footwear while riding a motorcycle having a foot actuated gear shift actuator, the protective device comprising a sole made of water impermeable material having a periphery and a generally flat bottom;

an upper of bodily flexible material secured adjacent the periphery of the sole to provide a rearwardly open receptacle for receiving a toe end of footwear of a motorcycle rider, the upper having at least one perforation allowing air movement adjacent the footwear of the rider, the upper being substantially more flexible than the sole, the upper having sides and a top, the top extending to a location where a rearwardly and upwardly inclined portion of the footwear ends and having a rearward end rearward of the sides, a rearward edge of the sides extending rearwardly upwardly at an acute angle from the sole to the top rearward end, the upper thereby protecting the top of the footwear from adjacent a toe of the footwear to the location where the rearwardly upwardly inclined portion of the footwear ends; and an adjustable strap secured to the protective device providing a loop for extending around the footwear of the rider for attaching the protective device to the rider, the loop having a maximum distance from the toe, the sole terminating about midway between the maximum distance of the loop and the toe;

the adjustable strap comprises a first section on one side of the upper including a first forked portion having a first lower leg attached to the side and a second upper leg attached to the top adjacent the rearward end and a second section on an opposite side of the upper including a second forked portion having a third lower leg attached to the side and a fourth upper leg attached to the top adjacent the rearward end, and an elongate connector extending around a heel of the footwear and securing the first and second forked portions together in an adjustable manner.

2. The footwear protective device of claim 1 wherein the protective device is washable.

3. The footwear protective device of claim 1 wherein the upper is inelastic fabric having a foam layer inside the fabric.

4. The footwear protective device of claim 1 wherein the upper provides an open toe allowing air movement through the receptacle, the open toe providing the at least one perforation and wherein the open toe of the upper contributes to flexibility of the upper allowing the upper to conform to footwear of different configuration.

5. The footwear protective device of claim 1 wherein the adjustable strap includes a section extending across the top rearward end, the section providing the second and fourth legs.

6. The footwear protective device of claim 5 wherein the upper provides slots adjacent the junction of the top rearward end and the sides and further comprising a strap section overlying the top rearward end and passing though the slots, opposite ends of the strap section providing the second and fourth legs of the adjustable strap.

7. The footwear protective device of claim 1 wherein at least one of the first and third legs extends horizontally parallel to the sole around the heel of the footwear and the connector adjustably connects the first and third legs together.

8. The footwear protective device of claim 1 further comprising footwear having a toe received in the receptacle of the foot protective device and providing a foot opening, the rearward top of the upper extending to immediately adjacent the foot opening.

* * * * *